United States Patent [19]

Franklin

[11] 4,174,552

[45] Nov. 20, 1979

[54] DRAPERY TIEBACK RING HOLDING CLIP

[76] Inventor: Edna M. Franklin, 1500 NW. 35, Oklahoma City, Okla. 73118

[21] Appl. No.: 914,245

[22] Filed: Jun. 9, 1978

Related U.S. Application Data

[63] Continuation-in-part of Ser. No. 855,860, Nov. 30, 1977, abandoned.

[51] Int. Cl.[2] ..... A44B 13/00

[52] U.S. Cl. ..... 24/73 CH; 24/73 HH; 24/230.5 W; 160/349 D

[58] Field of Search ..... 24/230.5 W, 73 CH, 73 HH, 24/73 HL; 248/303, 304, 339, 493, 497, 498; 160/349 D

[56] References Cited

U.S. PATENT DOCUMENTS

| | | | |
|---|---|---|---|
| 305,861 | 9/1884 | Taylor | 248/303 |
| 310,114 | 12/1884 | Atwood | 248/497 |
| 367,971 | 8/1887 | Gilbert | 248/304 |
| 619,915 | 2/1899 | Wentworth | 24/73 HL |
| 1,999,218 | 4/1935 | Tiryakian | 248/304 |
| 2,251,512 | 8/1941 | Bush | 160/349 D |
| 2,310,842 | 2/1943 | Davitt | 160/249 D |

FOREIGN PATENT DOCUMENTS

| | | | |
|---|---|---|---|
| 562939 | 7/1944 | United Kingdom | 248/303 |

*Primary Examiner*—Bernard A. Gelak
*Attorney, Agent, or Firm*—Robert K. Rhea

[57] ABSTRACT

A rigid wire material clip has its medial portion arcuately curved to form a screw receiving loop for attaching the clip to a vertical surface. The end portions of the clip diverge from the screw loop and are each doubled back upon itself to form a loop, lying in a plane normal to the screw loop, for releasably holding an endless ring, respectively.

3 Claims, 5 Drawing Figures

DRAPERY TIEBACK RING HOLDING CLIP

CROSS REFERENCE TO RELATED APPLICATION

This application is a continuation-in-part of an application filed by me in the U.S. Patent and Trademark Office on Nov. 30, 1977, Serial No. 855,860, now abandoned for DRAPERY TIEBACK RING HOLDING CLIP.

BACKGROUND OF THE INVENTION

1. Field of the Invention

The present invention relates to draperies and more particularly to a clip for releasably receiving drapery tieback endless rings.

The depending end portion of window curtain or drapery panels are frequently gathered and moved toward and secured to the window frame for exposing the window or opening particularly when the window is to be opened to permit air flow therethrough and prevent soiling the draperies, as by blowing against the window screen, if in place, or blowing out of the window. It is, therefore, desirable that some means be provided for securing drapery panels to the window frame with minimal damage to the window frame or creasing of the drapery material.

2. Description of the Prior Art

Prior patents, such as U.S. Pat. Nos. 1,518,824 and 2,053,332 generally disclose U-shaped members which are connected with respective sides of window frames or with the curtain rod, as in U.S. Pat. No. 2,190,764 for receiving the drapery material when manually disposed therein. This type of drapery panel tieback or support is an additional expense to the installation of draperies particularly where the tieback unit is of considerable length or is an adjustable type which is objectionable to some home owners because of its size and distance of projection from the wall or window frame.

Other patents, such as U.S. Pat. No. 367,971 and British Patent No. 562,939 (July 1944), disclose an article holding clip formed of wire material having one end adapted to be secured to a flat surface and having its other end doubled back upon itself to form a loop.

Other types of drapery panel tiebacks presently in use comprise a band-like length of fabric, usually formed from the material forming the drapery, which encircles the drapery panels when gathered in a pull back manner with the ends of the band commonly secured to the window frame by thumb tacks, or the like, resulting in maring the window frame surface. These drapery panel tieback bands are sometimes provided with an endless ring at its respective ends, the rings being engaged with a fastener commonly known as a cup hook. However, this cup hook fastener is unsatisfactory usually by the result of a drapery being released from its tieback position when contact is made with the pulled back drapery.

This invention is distinctive over the above named patents, the clip disclosed by my above listed application and the cup hook type of drapery tieback support by providing a relatively small wall mounted, intermediate its ends, wire-like clip which includes diverging end portions respectively forming loops for respectively receiving a resilient endless ring on the respective ends of tiebacks to securely hold them in place.

SUMMARY OF THE INVENTION

A short length of metallic rod material, such as wire, capable of being doubled back upon itself without failure of the rod material, is arcuately curved medially its ends to form a screw receiving loop. The end portions of the rod material diverge from the screw loop and are each doubled back upon itself toward the screw loop in a plane normal to the plane of the screw loop in one embodiment. In another embodiment, the free end portion of the doubled back end portion of the wire is arcuately curved in the plane of the doubled back portion to form a loop having an opening facing away from the screw loop thus forming an endless ring receiving loop in a plane normal to the vertical plane of a window frame when the clip is secured to the window frame by a screw. The surface of the screw loop, contacting the window frame mounting surface, is serrated to prevent angular rotation of the clip about the axis of its mounting screw.

The principal object of this invention is to provide a relatively small clip which may be easily connected with a window frame surrounding a drapery covered window for holding drapery and drapery panel tiebacks in close proximity with the window frame.

DESCRIPTION OF THE PREFERRED EMBODIMENTS

Figure 2:
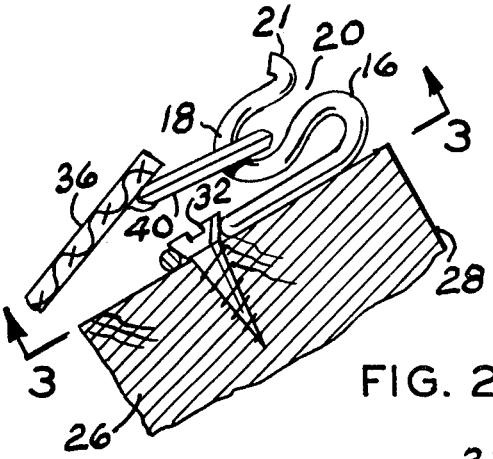
FIG. 2 is a view, partially in section, looking in the direction of the arrows 2—2 of FIG. 1 and illustrating the manner of attaching the clip to a fragment of a window frame with one end portion of a drapery tieback panel supported by the clip.

Like characters of reference designate like parts in those figures of the drawings in which they occur.

Figure 3:
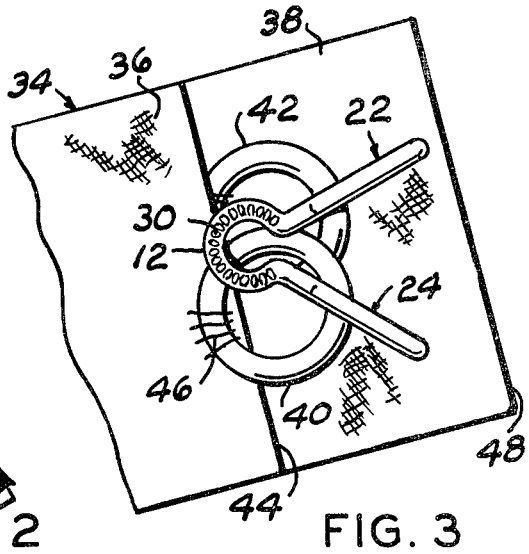
FIG. 3 is a view looking in the direction of the arrows 3—3 of FIG. 2 with the attaching screw removed for clarity and illustrating both end portions of a drapery tieback panel supported by the clip.
Figure 1:
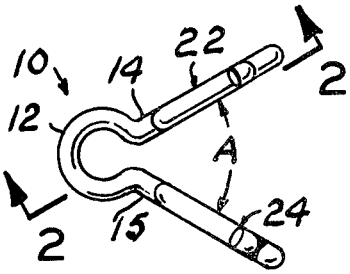
FIG. 1 is an elevational view of the drapery tieback clip.

In the drawings:

Referring more particularly to FIGS. 1 to 3, the reference numeral 10 indicates the clip which is formed from wire rod material capable of being arcuately curved or doubled back upon itself without structural failure of the wire material but which forms a clip not easily sprung or deflected from its finished configuration. Medially its ends the wire rod is arcuately curved to describe an arc of at least 190° and preferably approximately 300° to form a planar part circular screw receiving and retaining loop 12 with the end portions 14 and 15 of the wire rod material diverging from the screw loop 12 on an angle A of approximately 60°.

Each end portion of the wire rod material is doubled back upon itself intermediate its ends, as at 16, in a plane normal to the plane of the screw loop 12 and arcuately curved in a second doubled back fashion forming a loop 18 in the plane of the doubled back portion having an opening 20 facing in a direction opposite the screw loop 12. The free end portion of the doubled back portion is arcuately curved away from the doubled back bend, as at 21, thus forming a pair of hook portions 22 and 24. The width of the loop opening 20 is preferably such that a portion of an endless ring, formed from plastic material, may be resiliently received therein as presently explained.

The clip 10 is secured to an intermediate portion of a window casing or frame 26 by disposing the screw loop 12 flatly against the vertical surface of the window frame 26 with the hook portions 22 and 24 projecting in a direction opposite the window opening 28. The surface of the screw loop contacting the window frame 26 is preferably transversely scored or serrated, as at 30 (FIG. 3), to increase the coefficient of friction between the screw loop and window frame.

A screw, such as a flat head wood screw 32, is inserted through the closed loop 12 and driven into the material of the window frame 26 thus forming an anchor in combination with the serrations 30 normally preventing angular rotation of the clip 10 about the axis of the screw.

A drapery panel tieback comprising a fabric band 34 surrounding an intermediate portion of the depending end portion of a drapery panel, not shown, is attached, at its respective end portions 36 and 38 to endless rings 40 and 42, respectively.

The endless ring 40 is secured to the tieback end portion 36, adjacent its free end 44 and on its surface facing the window frame, as by stitching, indicated by the lines 46. The other ring 42 is similarly secured to the other tieback end portion 38 in spaced relation with respect to its free end 48. The cross sectional dimension of the respective ring 40 and 42 is substantially equal to the dimension of the opening 20 of the loop 18 to prevent accidental separation of the respective ring from the loop 18 when inserted thereinto. The rings are inserted into the clip loops 18 by manually forcing the ring through the loop opening 20 wherein the plastic material forming the respective ring is sufficiently resilient to permit passage of the ring. The ring 40 is engaged with one of the clip loops 18 and the ring 42 is engaged with the other loop so that the tieback end portion 38 overlies the clip 10 and ordinarily covers the entire clip end and other end portion 36 of the tieback.

Figure 5:
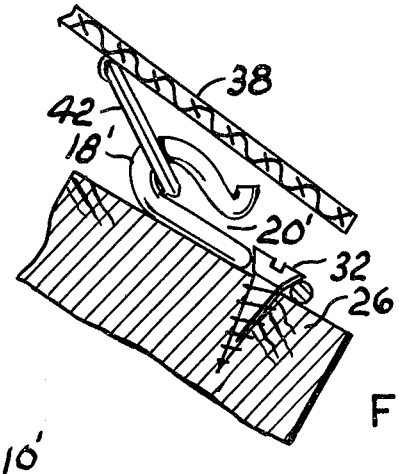
Figure 4:
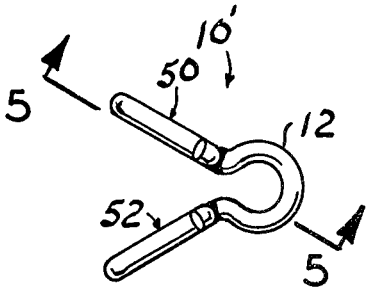
FIG. 4 is an elevational view similar to FIG. 1 illustrating another embodiment of the clip; and, FIG. 5 is a view similar to FIG. 2 looking in the direction of the arrows 5—5 of FIG. 4.

Referring more particularly to FIGS. 4 and 5, the numeral 10′ indicates another embodiment of the clip having a substantially identical plan view configuration with respect to the clip 10. The clip 10′ includes an identical screw loop portion 12 having a serrated window frame contacting surface and diverging hook portions 50 and 52. Each of the hook portions 50 and 52 are formed by doubling the respective end portion of the wire rod material back upon itself to form a loop 18′ lying in a plane normal to the plane of the screw loop 12 and forming a similar opening 20′ facing the screw loop for receiving the endless rings. The clip 10′ is similarly secured to a selected portion of the window frame 26 by the screw 32.

When securing the clip 10 or 10′ to the window the clip is preferably disposed so that the loop opening 20 or 20′ is generally facing away from the central portion of a drapery covered window.

Obviously the invention is susceptible to changes or alterations without defeating its practicability. Therefore, I do not wish to be confined to the preferred embodiment shown in the drawings and described herein.

I claim:

1. A support clip in combination with a drapery panel tieback having an endless ring secured to its respective end portions, the improvement comprising:

an elongated rod having its medial portion arcuately curved in a flat plane to form a part circular screw retaining loop and having intermediate portions disposed in diverging relation in the plane of the screw loop, the respective end portions of said rod being arcuately curved toward the screw loop to form an open loop lying in a plane normal to the plane of the screw loop for respectively receiving said endless rings.

2. The combination according to claim 1 in which the surface of the screw loop opposite the ring receiving loop is serrated.

3. The combination according to claim 2 in which the respective end portions of said rod are respectively doubled back upon themselves to dispose the opening of the ring receiving loop in a direction opposite the screw loop.

* * * * *